US006129815A

United States Patent [19]

Larson et al.

[11] Patent Number: 6,129,815

[45] **Date of Patent: *Oct. 10, 2000**

[54] ABSORBENT TOWEL/WIPER WITH REINFORCED SURFACE AND METHOD FOR PRODUCING SAME

[75] Inventors: Kenneth C. Larson, Appleton, Wis.; Richard R. Hepford, Folcroft, Pa.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,219

[22] Filed: Jun. 3, 1997

[51] Int. Cl.[7] ..... B31F 1/12

[52] U.S. Cl. ..... 162/112; 162/109; 162/123; 162/111; 162/117; 162/125; 264/283; 156/183

[58] Field of Search ..... 162/113, 108, 162/111, 112, 123, 125, 117; 264/282, 283; 156/183

[56] References Cited

U.S. PATENT DOCUMENTS

| | | | |
|---|---|---|---|
| 3,879,257 | 4/1975 | Gentile et al. . | |
| 3,903,342 | 9/1975 | Roberts, Jr. . | |
| 3,994,771 | 11/1976 | Morgan, Jr. et al. | 162/113 |
| 4,064,213 | 12/1977 | Lazorisak et al. . | |
| 4,125,659 | 11/1978 | Klowak et al. . | |
| 4,158,594 | 6/1979 | Becker et al. . | |
| 4,300,981 | 11/1981 | Carstens | 162/109 |
| 4,326,000 | 4/1982 | Roberts, Jr. . | |
| 4,429,014 | 1/1984 | Isner et al. . | |
| 4,849,054 | 7/1989 | Klowak | 162/109 |
| 4,886,579 | 12/1989 | Clark et al. . | |
| 5,102,501 | 4/1992 | Eber et al. | 162/129 |

*Primary Examiner*—Stanley S. Silverman
*Assistant Examiner*—Jose A. Fortuna
*Attorney, Agent, or Firm*—Nelson Mullins Riley & Scarborough

[57] ABSTRACT

The present invention provides a multi-layered wiping product that maintains desired characteristics of softness, strength, stretchability, absorbency, and the like. The wiping product is formed from a process using a multi-layered paper web, printing a bonding agent on both of its outer surfaces, pressing the web so it adheres tightly to a creping surface and lightly to a presser roll, and then creping one of its surfaces.

9 Claims, 3 Drawing Sheets

ABSORBENT TOWEL/WIPER WITH REINFORCED SURFACE AND METHOD FOR PRODUCING SAME

FIELD OF THE INVENTION

The present invention is generally directed to paper wiping products. More particularly, the present invention is directed to multiple layer paper wiping products made from a layered web of material that has been printed on both sides and creped on one side. The wiping products of the present invention are comparable in strength and bulk to known products but are less expensive to manufacture. In addition, the use of a layered web provides properties not heretofore available in known products.

BACKGROUND OF THE INVENTION

Disposable products made from papermaking fibers often serve as substitutes in both the home and in industrial shops for conventional cloth wipers and towels. Such paper products must closely simulate cloth in both consumer perception and performance. Such wiper products, including paper towels, industrial wipers, and other similar products, are designed to have several cloth-like properties.

For example, paper wiper products should exhibit good bulk, have a soft feel, have adequate strength even when wet, have good stretch characteristics, and resist tearing. These products should be highly absorbent and be abrasion resistant, and should not deteriorate in the environment in which they are used.

In the past, many attempts have been made to enhance certain physical properties of disposable wiping products. Unfortunately, however, when steps are taken to increase one property of a wiping product, other characteristics of the product may be adversely affected. For instance, in cellulosic-based wiping products, softness is typically increased by reducing cellulosic fiber bonding within the paper product. Inhibiting fiber bonding, however, usually adversely affects the strength of the paper web.

One method that has been employed to reduce the stiff papermaking bonds is to crepe the paper from a drying surface with a doctor blade, which disrupts and breaks many of the interfiber bonds in the paper web. Other methods reduce these bonds by preventing formation of the bonds, rather than breaking them after they are formed. Examples of these other methods are chemical treatment of the papermaking fibers to reduce their interfiber bonding capacity before they are deposited on the web-forming surface, use of unrefined fibers in the slurry, inclusion into the slurry of synthetic fibers which are unable to form papermaking bonds, and use of little or no pressing of the web to remove the water from the paper web after it is deposited on the web-forming surface. This latter method reduces formation of bonds by reducing close contact of the fibers with each other during the forming process. Although these methods successfully increase the softness of paper webs, they result in a loss of strength in the web.

Attempts to restore the strength lost by reduction of papermaking bonds have included the addition to the web of bonding materials that add more strength than stiffness to the web. Such bonding materials may be added to the aqueous slurry of fibers and deposited on the web-forming surface along with the fibers. With this method, the bonding material can be distributed evenly throughout the web, avoiding the harshness which would accompany concentrations of bonding material. However, this method has the disadvantage of reducing the absorbency of the web by filling the pores between the fibers with bonding material.

Another method which has been used to apply bonding material to the web is to apply the bonding material in a spaced-apart pattern to the web. In products made by this method, the majority of the web surface does not contain absorbency-reducing bonding material. This method is commonly employed in the field of nonwovens where little or no strength is imparted to the web by papermaking bonds, and almost all of the strength is obtained from the bonding materials.

In contrast to nonwoven webs, webs made entirely or principally from papermaking fibers require bonding areas to be quite close together because papermaking fibers are very short, generally less than one-quarter of an inch long. Thus, it has been thought that to apply sufficient bonding material in a pattern to a paper web to the degree necessary to bond each fiber into the network would result in a harsh sheet, having poor softness characteristics, particularly in the areas where the bonding material is located.

Another method that reduces the harshness in the web area where the bonding material is concentrated consists of forming a fibrous web under conditions which result in very low interfiber bonding strength by one of the previously described methods. Strength is then imparted to the web by apply bonding material to one surface of the web in a fine spaced-apart pattern. The harshness in the bonded areas is reduced by tightly adhering bonded portions of the web to a creping surface and removing the single-side bonded web with a doctor blade, thus finely creping the bonded portions to soften them. This form of controlled pattern creping also results in a number of other property improvements. For example, selective creping of the bonded areas in the surface of the web creates contraction of the web surface in all directions, resulting in an increase in stretch in both the machine direction and the cross-machine direction of the web. Also, the portions of the web where the bonding material is not located are generally disrupted by the creping action, resulting in an increase in bulk of the web, an increase in the softness of the web, and an increase in absorbency. At certain locations within the web, generally close to the bonding material locations, the web may develop internal split portions which further enhance the absorbency, softness, and bulk of the web. This effect does not occur, at least to the same extent, in the web formed by addition of bonding material to the aqueous slurry of fibers.

This one-sided bonded/creped method produces a paper web with high softness and strength, two properties which were previously believed to be almost mutually exclusive in paper webs. It also produces a web with adequate absorbency properties due to the bonding material being confined to only a portion of the web surface. Furthermore, the compaction of the surface fibers due to the shrinkage of the areas containing bonding material creates one surface of the web which has improved wipe-dry characteristics upon being finely creped. It is also believed that pressing the web to the creping surface while the web has moist portions on the surface region due to the uncured or undried bonding material causes the fibers in those moist areas to compact.

This method is particularly useful in production of webs in a lower basis weight range for use such as bathroom tissues. However, it has shortcomings in making webs for heavier duty use such as for towels and wipers where greater strength, bulk and absorbency is desired. Examples of such shortcomings are poor abrasion resistance on the nonbonded side of the web and less strength than may be desired. Both of these properties could be improved by causing the bonding material to penetrate completely through the web to create a network of bonding material on both sides of and entirely through the web, but it has been found that such one-side bonded, thoroughly penetrated webs would have less of the improvements described above.

For example, bonding the web with the bonding material extending completely through the web would greatly reduce the disruption of the fibers within the web upon creping and, therefore, result in a reduction of bulk, softness, and absorbency. Also, complete penetration of the bonding material through the web is difficult to accomplish on heavier basis weight webs and attempts to do so result in concentrations of excess bonding material at the web surface where much of it is ineffective for strengthening interfiber bonds. Furthermore, if complete penetration of the bonding material does result, the bonding material in the interior of the web will not be as efficiently used to increase abrasion-resistance of the web as when it is placed only in the surface of the web. Placement of the bonding material in the interior of the web is not only an inefficient use of the expensive bonding material, but results in a harsher feel to the web due to the inability of the creping action to soften the bonded portions as effectively. Also, bonding completely through the web would reduce the ability to create on both sides of the web a web surface of compacted fibers having good wipe-dry characteristics while at the same time creating a bulky web capable of absorbing a larger amount of moisture. These properties are only of minor importance when producing a product for such uses as bathroom tissues, but where the product is to be used for wipers or towels, they are very important.

One particular process that has proved to be successful in producing paper towels and other wiping products is disclosed in U.S. Pat. No. 3,879,257 to Gentile, et al., which is incorporated herein by reference in its entirety. In Gentile, et al., a process is disclosed for producing soft, absorbent, single-ply fibrous webs having a laminate-like structure that are particularly well suited for use as wiping products.

The fibrous webs disclosed in Gentile, et al. are made from a fibrous web formed from an aqueous slurry of principally lignocellulosic fibers under conditions which reduce interfiber bonding. After formation, the web is usually creped prior to further processing. A bonding material, such as a latex elastomeric composition, is then applied to a first surface of the web in a spaced-apart pattern. In particular, the bonding material is applied so that it covers from about 50 percent to about 60 percent of the surface area of the web. The bonding material provides strength to the web and abrasion resistance to the surface. Once applied, the bonding material can penetrate the web preferably from about 10 percent to about 40 percent of the thickness of the web.

The bonding material is then similarly applied to the opposite side of the web for further providing additional strength and abrasion resistance. Once the bonding material is applied to the second side of the web, one side of the web is brought into contact with a creping surface. The web adheres to the creping surface according to the pattern to which the bonding material was applied. The web is then creped from the creping surface with a doctor blade, which greatly disrupts the fibers within the web where the bonding material is not disposed, thereby increasing the softness, absorbency, and the bulk of the web.

In a preferred embodiment disclosed in Gentile, et al., each side of the paper web is creped after the bonding material has been applied to the side. Gentile et al. also discusses the use of chemical debonders to treat the fibers prior to forming the web in order to further reduce interfiber bonding and to increase softness and bulk.

Another method employed to produce a wiper-like paper product having the desirable bulk, absorbency, and abrasion-resistance, is to laminate two or more embossed conventional paper webs together with an adhesive. One advantage of this method is that the tightly compacted fibers of the conventional paper webs offer good wipe-dry properties on both sides of the sheet while, at the same time, the void spaces between the webs created by the embossments spacing the webs from each other increase the ability of the web to hold moisture. Examples of this method are disclosed in U.S. Pat. Nos. 3,414,459 and 3,556,907. The disadvantages of this method are apparent when considering the complex process involved in separately embossing two or more webs and then bringing them together with synchronism to prevent complete nesting of the embossed protuberances of one web into the embossed protuberances of the other web. Also, any given length of the multi-ply product requires initial production on a papermaking machine of a web two or more times as long. It is also apparent that the adhesive used to interconnect the plies to each other will present unpleasant stiffness at the location where the adhesive is disposed.

Multi-ply embossed paper products, however, are quite desirable in that they can be made very bulky compared to their weight, due to the void spaces between the plies created by the embossed protuberances holding the plies apart from each other. Because of this construction, multi-ply products are easily compressed between the finger of the consumer, thereby aiding in providing a feeling of softness.

The processes disclosed in Gentile et al. have provided great advancements in the art of making disposable wiping products. The products, however, tend to be somewhat expensive, in part, because two printing (or latex bonding) processes and two creping processes are generally involved. Thus, it would be desirable if disposable wiping products having properties similar to those disclosed in Gentile et al. could be produced at lower costs.

SUMMARY OF THE INVENTION

The present invention recognizes and addresses the foregoing drawbacks, and deficiencies of prior art constructions and methods.

It is an object of the present invention to provide an improved towel or wiper having reinforced surfaces.

It is another object of the present invention to provide wiping products that can be made at a lower cost with fewer process steps than those made by the double-bonding, double-creping commercial process described in Gentile et al.

Another object of the present invention is to provide a wiping product that exhibits characteristics comparable to the products produced according to the process of Gentile et al. but which also possesses additional characteristics common to products made from multiple layers of paper fibers.

It is a further object of the present invention to provide an absorbent wiping product having improved reinforced surfaces on both sides of the product.

Another object of the present invention is to provide a wiping product that exhibits different abrasion resistance characteristics on its surfaces.

These and other objects are achieved by providing an absorbent wiping product made of multiple cellulosic web layers that has been printed, or bonded, on both of its surfaces and creped on only one surface.

More specifically, a multi-layered, relatively thick, cellulosic-containing base paper is formed. One surface of the multi-layered web is then printed with a bonding material, with a pattern, and then the other surface is printed with a bonding material, with a pattern. The web is then pressed to a creping surface with a silicone presser roll under a pressure and temperature such that one side of the web adheres lightly to the presser roll, and the other side adheres strongly to the creping surface. The presser roll tends to delaminate and increase the caliper of the web. The web then releases from the presser roll but remains adhered to the creping surface where it is dried before being creped from the creping surface with a doctor blade, or comparable creping knife, thereby resulting in a multilayered product having increased softness, absorbency, and bulk, with a high amount of strength and elasticity. Although FIG. 2 of Gentile et al. shows a double side-bonded, single side-creped configuration, Gentile et al. never described, or in any way anticipated, the necessary role of the presser roll in combination with low-density non-compressive-dried base sheets.

BRIEF DESCRIPTION OF THE DRAWINGS

A full and enabling disclosure of the present invention, including the best mode thereof, to one of ordinary skill in the art is set forth more particularly in the remainder of the specification, including reference to the accompanying figures, in which.

Figure 1:
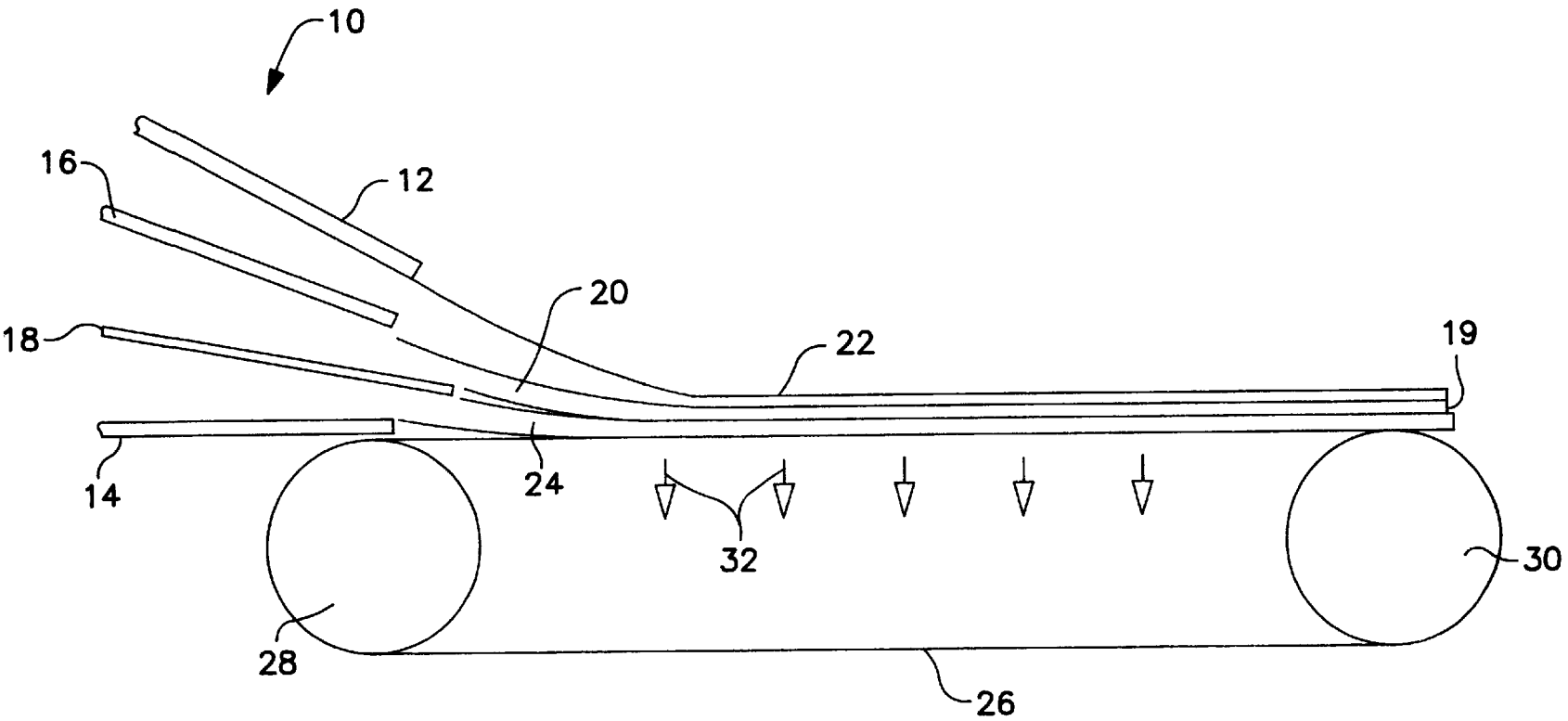
FIG. 1 is a schematic side elevation view of a paper web forming machine illustrating the formation of a paper web having multiple layers in accordance with the present invention.

Repeat use of reference characters in the present specification and drawings is intended to represent same or analogous features or elements of the present invention.

DETAILED DESCRIPTION OF PREFERRED EMBODIMENT

It is to be understood by one of ordinary skill in the art that the present discussion is a description of exemplary embodiments only and is not intended as limiting the broader aspects of the present invention, which broader aspects are embodied in the exemplary construction.

The present invention addresses the objectives and needs discussed above by providing a process using a multi-layered web, printing or applying adhesive on both surfaces of the web, and then creping one surface of the web.

The web may have an undulating disposition due to controlled pattern creping of the web through use of the patterned-applied bonding material as a creping adhesive. The controlled pattern creping increases the web's bulk and absorbency, as well as its softness and compressibility. It also finely crepes the areas in the surface region of the web where the bonding material is disposed and has been used to pattern adhere the web to the creping surface.

"Fine creping" as the term is used in the specification and claims, is the resulting creping effect which occurs to the portions of a web held tightly to a creping surface with adhesive. It may manifest itself in the adhesively adhered portions in greater fore-shortening and/or greater number of creping bars and/or a greater degree of softening than would have been obtained by creping of the same portions of the web without the use of adhesive. Where the fine creping is confined to a pattern on the web, it causes the creping effect on the entire web to be predominately concentrated in the areas of the web which are adhesively adhered to the creping surface and, thus, produces a patterned crepe.

The bonding material is disposed only part way through the web, preferably to between about 10 and about 40 percent of the finished web thickness on each side, to enable the controlled pattern creping to produce maximum process improvements of bulk, softness and absorbency and to provide the most efficient use of the bonding material. In some embodiments of the web, the bonding material is disposed between about 10 and about 60 percent through the finished web product on both sides of the web but, in such embodiments, either because of the particular patterns in which the bonding materials are applied, or because of the bonding material penetrating much less on one side of the web than on the other, the bonding material in one surface is substantially unconnected to the bonding material in the other surface. Disposing the bonding material on both sides of the web without complete penetration of the bonding material through the web or connection of bonding material from one side with that of the other enables the development of greater bulk increase from equal amounts of controlled pattern creping and greater strength than obtainable with the same amount of bonding material applied from one side only and completely penetrating the web. The web may be treated prior to application of the bonding material to reduce the interfiber bonding of the lignocellulosic fibers created by papermaking bonds.

The method of the present invention consists of forming a multi-layered, relatively thick, fibrous web, applying a bonding material, such as an elastomeric to a first surface of the web, then applying bonding material, which may be the same or a different bonding material, to the second surface of the web. The web is then pressed to a creping surface with a silicone presser roll under a pressure and temperature such that one side of the web adheres lightly to the presser roll, and the other side adheres strongly to the creping surface. The presser roll tends to delaminate and increase the caliper of the web. The web then releases from the presser roll but remains adhered to the creping surface where it is dried then creped from the creping surface with a doctor blade to greatly disrupt the fibers within the web where the bonding material is disposed, thereby resulting in a multi-layered product with increased softness, absorbency, and bulk.

In forming the multi-layered paper web of the present invention, paper fibers are combined in layers to form a stratified web. When forming a stratified fiber furnish, layers of two or more fibers may be combined into the final web. The layers may consist of any type of pulp or grade of fiber. In fact, in some embodiments, different types of pulps would be desirable so as to cause the final product to exhibit qualities of both types of pulp. A preferred embodiment uses 100 percent Northern Softwood Kraft fibers in the two surface layers.

Referring to FIG. 1, one embodiment of a device for forming a multi-layered stratified pulp furnish is illustrated. As shown, a three-layered headbox (not shown in full) generally 10 includes a upper head box wall 12 and a lower headbox wall 14. Headbox 10 further includes a first divider 16 and a second divider 18 which separate three fibrous stock layers.

Each of the fiber layers comprises a dilute aqueous suspension of papermaking fibers. In accordance with the present invention, layers 22, 20, and 24 may comprise any grade or type of pulp and may be the same types and grades or different types and grades. In addition, although not shown, the headbox could be constructed to provide two, four, five and so forth, layers of fibers.

An endless traveling forming fabric 26, suitably supported and driven by rolls 28 and 30, receives the layered papermaking stock issued from headbox 10. Once retained on fabric 26, the layered fibrous suspension passes water through the fabric as shown by the arrows 32. Water removal is achieved by combinations of gravity, centrifugal force, and vacuum suction, depending on the particular forming configuration. Forming multi-layered paper webs is described and disclosed in U.S. Pat. No. 5,129,988 to Farrington, Jr. and in U.S. Pat. No. 5,494,554 to Edwards et al., which are both incorporated in their entireties herein by reference.

The cellulosic-based, pulp fibers, used in the present invention may be woody and/or non-woody plant fiber pulps. The pulp may be a mixture of different types and/or qualities of pulp fibers, or, alternatively, one type or grade of pulp may comprise 100 percent of each pulp fiber layer. For example, a pulp containing both low-average fiber length pulp and high-average fiber length pulp (e.g., virgin softwood pulp) may be used.

Low-average fiber length pulp may be characterized as having an average fiber length of less than about 1.2 mm, usually from about 0.7 mm to about 1.2 mm. High-average fiber length pulp may be characterized as having an average fiber length of greater than about 1.5 mm, usually from about 1.5 mm to about 6 mm.

Low-average fiber length pulp may be certain grades of virgin hardwood pulp and low-quality secondary (i.e., recycled) fiber pulp from sources such as, for example, newsprint, reclaimed paperboard, and office waste. High-average fiber length pulp may be bleached and/or unbleached virgin softwood pulps.

Wood pulps of long, flexible fibers that have a low coarseness index are useful for the cellulosic surface layers of the present invention. Illustrative examples of suitable pulps include southern pines, northern softwood kraft pulps, red cedar, hemlock, eucalyptus, black spruce and mixtures thereof. Exemplary commercially available long pulp fibers suitable for the present invention include those available from Kimberly-Clark Corporation under the trade designations "Longlac-19," "Coosa River-54," "Coosa River-56," and "Coosa River-57."

The pulp fibers used in the present invention may be unrefined or may be beaten to various degrees of refinement. Small amounts of wet-strength resins and/or resin binders may be added to improve strength and abrasion resistance. Useful binders and wet-strength resins include, for example, KYMENE 557 H resin available from the Hercules Chemical Company and PAREZ 631 resin available from American Cyanamid, Inc. Cross-linking agents and/or hydrating agents, as known in the art, may also be added to the pulp mixture. Debonding agents may also be added to reduce the degree of hydrogen bonding if a very open or loose non-woven pulp fiber web is desired. One exemplary debonding agent is available from the Quaker Chemical Company of Conshohocken, Pa., under the trade designation "Quaker 2008." The addition of certain debonding agents in the amount of, for example, 0.1 to 2 percent, by weight, of the composite reduces the density of the web so that the web separates better at the presser roll.

The cellulosic layers may also contain a minor amount of hydrophilic synthetic fibers, e.g., rayon fibers and ethylene vinyl alcohol copolymer fibers, and hydrophobic synthetic fibers, e.g., polyolefin fibers. Desirably, the cellulosic web has a basis weight of between about 10 pounds per ream ("lb/R") and about 60 lb/R, and more desirably between about 15 lb/R and about 30 lb/R.

Web 19 formed by the process shown in FIG. 1 may be dried according to known means. In particular, a non-compressive drying process must be used. In particular, the dryer shown in U.S. Pat. No. 3,432,936, which is incorporated herein in its entirety by reference thereto, exhibits a dryer that removes moisture from a web by passing air through the web to evaporate the moisture without applying any mechanical pressure to the web. A known through-dryer apparatus may be used having an outer rotatable cylinder with perforations in combination with an outer hood for receiving hot air blown through the perforations. A through-dryer belt carries the material to be dried over the upper portion of the through-dryer outer cylinder. Heated air forced through the perforations in the outer cylinder of the through-dryer removes water from the web. The temperature of the air forced through the web by the through-dryer may range from about 200° to about 500° F. Other useful through-drying methods and apparatus may be found in, for example, U.S. Pat. Nos. 2,666,369 and 3,821,068, both of which are incorporated in their entireties herein by reference.

Figure 2:
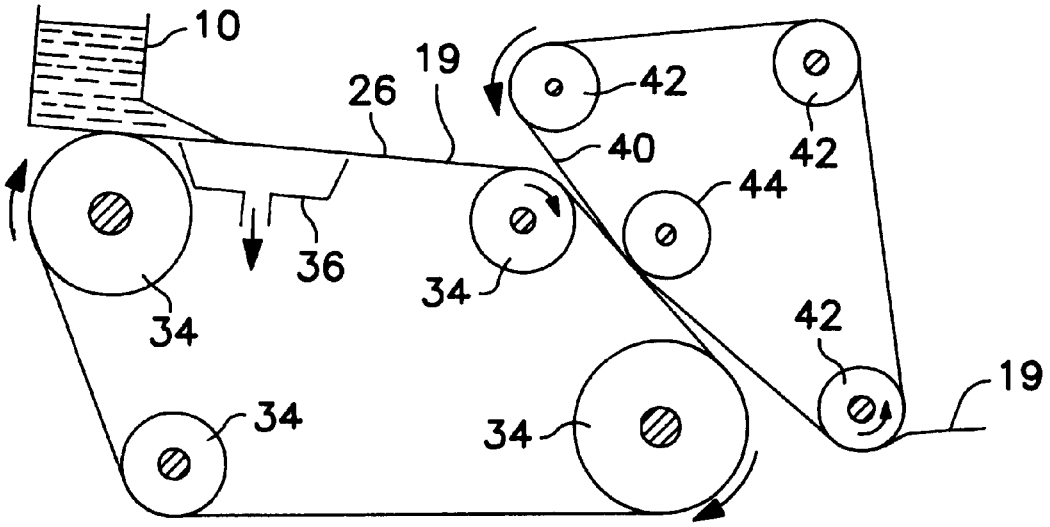
FIG. 2 is a schematic side elevation view of additional elements of a paper web forming machine illustrating the formation of a paper web having multiple layers in accordance with the present invention.

FIG. 2 illustrates more explicitly a paper making machine capable of receiving the layered fiber suspension from headbox 10 and forming a paper web for use in the process of the present invention. As shown, forming fabric 26 is supported and driven by a plurality of guide rolls 34. A vacuum box 36 is disposed beneath forming fabric 26 and is adapted to remove water from the fiber furnish to assist in forming a web.

From forming fabric 26, a formed layered web 19 may be transferred to a second fabric 40, which may be either a wire or a felt. Fabric 40 is supported for movement around a continuous path by a plurality of guide rolls 42. Also included is a pick up roll 44 designed to facilitate transfer of web 19 from fabric 26 to fabric 40. Preferably, the speed at which fabric 40 is driven is slower than the speed at which fabric 26 is driven. This allows for a rush transfer process to add stretch characteristics to the product. Sufficient stretch is added so that initial creping of the web prior to bonding is unnecessary in this embodiment. Web 19 is removed from fabric 40 by another vacuum roll (not shown) onto another fabric (not shown) for drying.

After such processing, web 19 may then be provided to various drying stations according to any of the known drying processes. At this point, regardless of the particular apparatus or process utilized, a web is formed which can be treated in accordance with the method of the present invention to form a double-bonded, single-creped, multilayer sheet material.

The web may comprise two or more layers of principally lignocellulosic fibers like wood pulp or cotton linters used in papermaking which are short fibers of less than one-fourth inch length. However, the web may be formed with a portion of or all of the fibers being relatively longer fibers and still retain advantages of the present invention. Examples of such relatively longer fibers are cotton, wool, rayon, regenerated cellulose, cellulose ester fibers such as cellulose acetate fibers, polyamide fibers, acrylic fibers, polyester fibers, vinyl fibers, protein fibers, fluorocarbon fibers, dinitrile fibers, nitrile fibers, and others, natural or synthetic. The length of these other fibers may be up to about two and one-half inches long, although shorter lengths may be advantageous in forming the web on conventional papermaking equipment. A product can be produced from a combination of papermaking fibers and from about 10 to 15 percent short rayon fibers. The web may also be dry-formed such as on conventional air-lay equipment using a combination of papermaking fibers and relatively longer synthetic fibers, or either alone. It is particularly advantageous for economic and other reasons to use at least 50 percent papermaking fibers. And it is also particularly advantageous for the fibers to be randomly oriented rather than aligned.

The web 19 preferably has a basis weight such that in the finished web product, the basis weight will be between about 20 and about 100 pounds, and more preferably between about 25 and about 60 pounds, per 2880 square feet. This means that the web 19, upon being formed into a base web, should have a basis weight between about 16 and 80 pounds, and more preferably between about 22 and about 45 pounds per 2880 square feet, in practicing the preferred forms of the invention. Sheet products in this general range benefit most from the method of the invention since they are largely used where the features of the invention are important. It is in this range of basis weights where the process is most successful in imparting the desired properties to the invention.

The layered web, just prior to being subjected to the process steps of the invention, preferably possesses certain physical characteristics so that when it is treated by subsequent steps of the method of the invention, it is transformed into a sheet material of superior properties. Broadly described, these characteristics possessed by the web to be treated are generally evidenced by a reduced amount of interfiber bonding strength in the web. The effect of such reduced interfiber bonding strength is to substantially alter a number of characteristics of the web, such as the caliper and softness of the web as well as the overall strength of the web, when subjected to the process of the invention.

Thus, although any fibrous web may be advantageously treated by the method of the present invention to create a softer, stronger, and generally bulkier web, the preferred form of sheet material of the present invention is made by treating webs which initially are relatively soft, relatively thick, and quite weak. All of these properties are generally possessed by a web which has low interfiber bonding strength. The method of the present invention then imparts an improved combination of softness, bulk, absorbency, and strength to such webs.

In some instances, the fibers utilized to form the layered web 19 may be treated to reduce their bonding by such means as use of unrefined fibers or addition of synthetic fibers which do not form papermaking bonds. Also, the fibers can be treated with a chemical debonder placed either in the fiber furnish, or applied after formation of the web but prior to drying, such as when the web is carried on the wire 26. Such chemical debonders are commonly used to reduce the number of sites along the individual fibers which are susceptible to interfiber bonding of the type utilized in papermaking. Debonding agents which may be used for this purpose include the cationic debonding agents disclosed in U.S. Pat. No. 3,395,708, which are substances within the class of long chain cationic surfactants, preferably with at least 12 carbon atoms and at least one alkyl chain, such as fatty dialkyl quaternary amine salts, mono fatty alkyl tertiary amine salts, primary amine salts, and unsaturated fatty alkyl amine salts; the cation-active tertiary amine oxides disclosed in U.S. Pat. No. 2,432,126; and the cation-active amino compounds disclosed in U.S. Pat. No. 2,432,127.

In combination with any of the methods described above, or alone, interfiber bonding strength is further reduced if the web is formed under conditions of reduced pressing while it is wet. That is, the web is not subjected to significant compression between two elements or surfaces until it is substantially dried (preferably at least 80 percent dry) in certain embodiments. Thus, contrary to typical papermaking techniques as disclosed in FIG. 2, wherein a pick-up roll is used to press a felt into engagement with a web on a wire to transfer the web from the wire to the felt, the transfer in this embodiment may be accomplished by the use of air or vacuum or both.

The use of any of these systems accomplishes web transfer without the application of pressure in any substantial amount to the web. Consistent with these systems, the web should not be pressed while wet into engagement with a surface of the Yankee dryer by means such as a pressure roll, a step commonly done on conventional papermaking machines, but rather drying should be accomplished through the use of air flowing over or through a web as by the transpiration drying process disclosed in U.S. Pat. No. 3,432,936. The fibers forming the web are, therefore, not pressed into intimate engagement with one another while the web is wet, and the number of contact points between fibers is reduced, resulting in a reduction of interfiber bonding strength. Such conditions of reduced pressing are preferably maintained until the web is substantially dried so that few interfiber bonds are formed.

Of course, the foregoing clearly indicates that a press section, such as is conventionally used to extract moisture from a freshly formed web prior to thermal drying, should not be employed when performing the reduced wet pressing method of the invention. Such a press section would result in substantial compaction of the web, thereby increasing the number of interfiber bonds and decreasing the caliper of the web when it is dried.

The best web softening results are obtained where the fibers in the web are treated with a chemical debonder or when the web is formed under conditions of little or no pressing while it is wet, or when a combination of the above conditions is present. Since bulk and softness are properties which the method of the present invention is utilized to obtain, it is desirable to optimize those properties in the web prior to treatment by the method of the present invention in order to enable them to be even further improved. But, regardless of the particular form of the web, treatment by the method of the present invention will enhance the bulk, softness and strength properties and impart substantial stretch to it in all directions in its own plane, in addition to improving other properties desirable in a wiper product.

The paper web formed from the processes illustrated in FIG. 2 and described above, possesses certain physical characteristics that are particularly advantageous for use in the remainder of the process of the present invention. In particular, paper web 19 is characterized by having an increased amount of softness, bulk, absorbency, stretch, and wicking ability. As will be described hereinafter, the remainder of the process of the present invention is designed not only to retain the above properties but also to provide the paper web with strength and stretchability.

Figure 3:
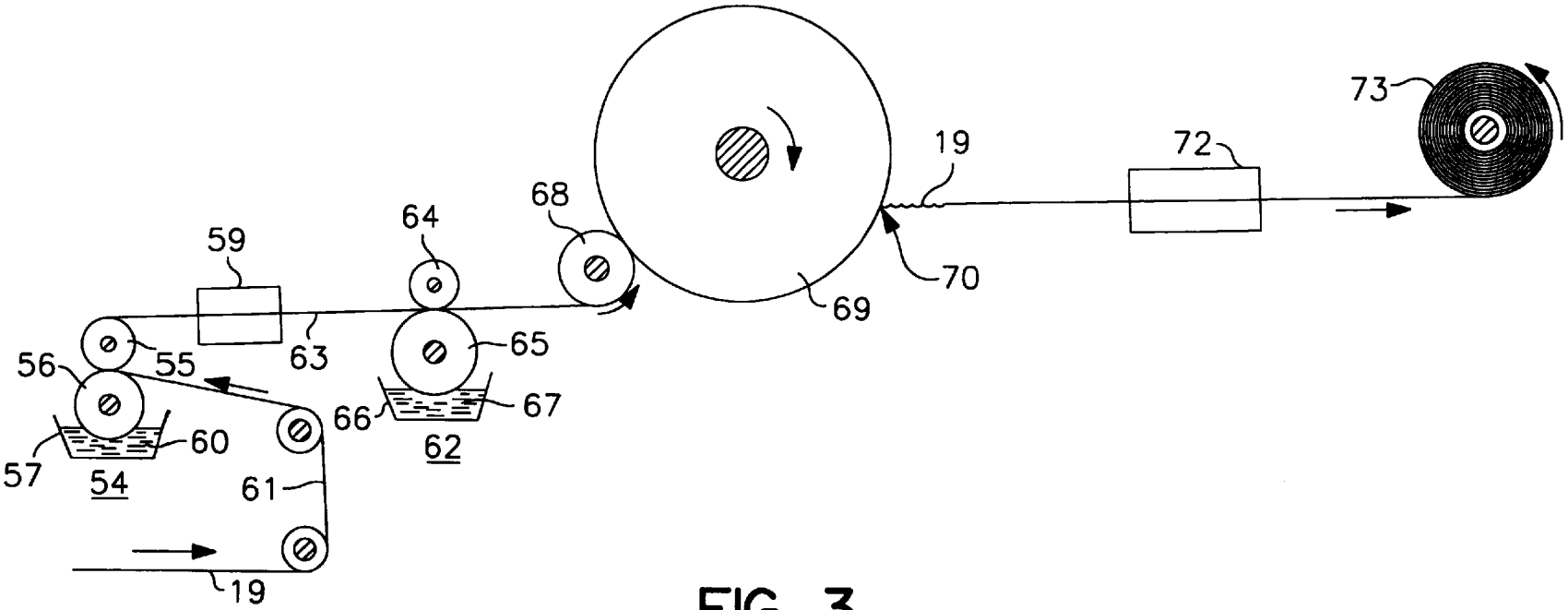
FIG. 3 is a schematic side elevation view of a portion of one form of apparatus for carrying out the method steps of the present invention.

Once multilayered paper web 19 is formed, a bonding agent is applied to each side, or surface, of the web, one side is pressed to a creping surface with a silicone presser roll, and the web is then creped. For instance, a creping process that may be used in the process of the present invention is disclosed with respect to FIG. 2 in U.S. Pat. No. 3,879,257 to Gentile et al. FIG. 3 of the present specification illustrates one embodiment of an apparatus that may be used to bond each side and crepe one side of a paper web.

As shown, multilayered paper web 19 made according to the process illustrated in FIGS. 1 or 2, or according to a similar process, is passed through a first bonding-material application station 54. This station 54 includes a nip formed by a smooth rubber press roll 55 and a patterned metal rotogravure roll 56. The lower transverse portion of the rotogravure roll 56 is disposed in a pan 57 containing a first bonding material 60. The rotogravure roll 56 applies an engraved pattern of bonding material 60 to one surface 61 of the web 19 as the web 19 passes through the nip. The web 19 may be passed through a drying station 59 where the adhesive is partially dried or set sufficiently to prevent it from sticking to the press roll in the next bonding-material application station but not so much that it will not stick to the presser roll 68 on the creping surface. The drying station 59 may consist of any form of heating unit well known in the art, such as ovens energized by infrared heat, microwave energy, hot air, etc.

Web 19 then passes through a second bonding-material application station 62 where bonding material is applied to the opposite side 63 of the web 19. The second bonding-material application station 62 is illustrated by smooth rubber press roll 64, rotogravure roll 65, and pan 66 containing a second bonding material 67. This bonding material is also applied to the web 19 in a pattern arrangement, although not necessarily in the same pattern as that in which bonding material is applied to the first side 61. Even if the two patterns are the same, it is not necessary to register the two patterns to each other. In addition, the same or different bonding material can be applied at the second bonding material application station 62.

Web 19 is then pressed into adhering contact with the creping drum surface 69 by a silicone presser roll 68. The first bonding material 60 causes the coated portions of the first surface of the web to adhere slightly to the presser roll 68, and the second bonding material 67 causes only those portions of the web 19 where it is disposed to adhere tightly to the creping surface 69. Web 19 is carried on the surface of the creping drum 69 for a distance and then removed therefrom by the action of a creping doctor blade 70, which performs a conventional creping operation on the bonded portions of the web 19. That is, it imparts a series of fine fold lines (crepe bars) to the portions of the web 19 which adhere to the creping surface 69. The creping surface 69 can be provided by any form of surface to which the bonding adhesive will tightly adhere to enable creping of the web 19 from the surface 69. Preferably, the creping surface 69 is heated to increase the adhesion of the web to the drum and to dry the web. An example of a suitable creping surface is a Yankee dryer.

It has been found that in the present invention, it is important to ensure that the surface of the paper web which will be creped from the creping surface 69 is sufficiently adhered to that creping surface prior to being creped therefrom. Accordingly, it is preferred that sufficient bonding agent be used to ensure sufficient adhesion at the contact surface.

Presser roll 68 provides the desired aspects of the present invention. When this roll has a silicone rubber of 65 shore A hardness, the web with binder adheres to the roll sufficiently to cause a large increase in the caliper of the creped product. The use of a Teflon-covered roll or a roll sprayed with additional silicone resulted in the web not adhering as well to the presser roll 68, thus resulting in a less desirable product. When the moisture in web 19 was varied, wetter sheets adhered more easily to the silicone roll 68.

Although the use of Teflon-covered roll or a roll sprayed with additional silicone resulted in a less desirable product than that obtained when using a silicone-covered presser roll, other forms of presser rolls may be used to achieve the desired aspects of the present invention. Suitable presser rolls must provide sufficient pressing force in order to allow the opposite side 63 of web 19 to adhere tightly to creping surface 69. In addition, presser rolls should be sufficiently tacky to allow the first surface 61 of web 19 to adhere lightly thereto. Through use of presser rolls having such characteristics, the web is sufficiently delaminated relative to first surface 61 by the light adherence provided by presser roll 68.

If an insufficiently tacky presser roll is used, for example a Teflon-covered roll, then a second roll may be incorporated into the process for creating the desired delamination of web 19. In such an instance, an insufficiently tacky Teflon-covered presser roll may be used to create a tight adherence of surface 63 of web 13 to creping surface 69 and the second backup roll (not shown) may be sufficiently tacky to allow first surface 61 of web 19 to lightly adhere thereto. The presser roll would then work in combination with this second backup roll in order to provide results similar to those achieved with use of a silicone-covered presser roll. Other forms of presser rolls, such as presser rolls having a neoprene cover, could also be modified or designed to achieve the necessary tight adherence of second surface 63 to creping surface 69 and the light adherence of first surface 61 to the roll in order to create the necessary delamination of web 19 during the process. Such designs would be within design parameters of those of ordinary skill in the art.

The web 19 is then optionally passed through a curing station 72 to cure the bonding material on both sides of the web 19 if curing is required. The curing station 72 may be of any form known by those skilled in the art, such as those forms described for drying station 59. After passing through the curing or drying station 72, the web 19 is wound into a parent roll 73 by conventional winding means (not shown). It may then be transferred to another location to cut it into commercial size sheets for packaging.

Referring to the apparatus illustrated in FIG. 3, some variation is permissible in the bonding-material application stations. For example, the second application station could be arranged to print the bonding material directly on the creping drum just prior to placing the web 19 into contact with it as long as sufficient time is allowed for the web to pick up sufficient binder to adhere to the creping drum. Other variations could also be practiced as well, keeping in mind that each station must apply bonding material to the opposite side of the web as the other station. Also, the bonding material application station can be provided by means other than rotogravure rolls, such as by flexographic means or by spraying means, including the use of silk screening.

The pattern of bonding material applied to the web 19 can be on either side, and must be on one side, in any form of fine lines or fine areas which leaves a substantial portion of the surface of the web 19 free from bonding material. Preferably, the pattern should be such that the bonding material occupies between about 15 percent and about 60 percent of the total surface area of the web, leaving between about 40 percent and about 85 percent of each surface of the web free from bonding material in the finished web product. The patterns disclosed in U.S. Pat. Nos. 3,047,444, 3,009,822, 3,059,313 and 3,009,823 may be advantageously employed. Some migration of bonding material occurs after printing, and the pattern of the rotogravure roll is chosen accordingly. Thus, the bonding material penetrates partially through the web 19 and in all directions of the plane of the web 19. Migration in all directions in the plane of the web may be controlled to leave areas of between about 50 percent and about 75 percent of the finished web surface free from bonding materials.

The bonding material utilized in the process and product of the preferred form of the present invention must be capable of several functions, one being the ability to bond fibers in the web to one another and the other being the ability to adhere the bonded portions of the web to the surface of the creping drum and to the presser roll.

In general, any material having these two capabilities may be utilized as a bonding material, preferably if the material can be dried or cured to set it. Among the bonding materials which are capable of accomplishing both of these functions and which can be successfully used are acrylate latex rubber emulsions, useful on unheated as well as heated creping surfaces; emulsions of resins such as acrylates, vinyl acetates, and methacrylates, all of which are useful on a heated creping surface; and water soluble resins such as carboxy methyl celluloses, polyvinyl alcohols, and polyacrylamides. In one preferred embodiment, the bonding agent used in the process of the present invention comprises an ethylene vinyl acetate copolymer. In particular, the ethylene vinyl acetate copolymer is cross-linked with N-methylol acrylamide groups using an acid catalyst. Suitable acid catalysts include ammonium chloride, citric acid, and maleic acid. The bonding agent should have a glass transition temperature of not lower than −30° C. and not higher than +10° C.

However, in other instances, the bonding material may comprise a mixture of several materials, one having the ability to accomplish interfiber bonding and the other being utilized to create adherence of the web to the creping surface 69 and presser roll 68. In either instance, the materials are preferably applied as an integral mixture to the same areas of the web.

Such materials may also comprise any of the materials listed above, mixed with a low molecular weight starch, such as dextrin, or low molecular weight resin such as carboxy methyl cellulose or polyvinyl alcohol. It should be noted here that when practicing the form of the invention which does not require two controlled pattern crepes, one of the bonding materials can be chosen for its ability to bond fibers together and adhere to the presser roll 68 only.

In forming one product of the present invention, elastomeric bonding materials are employed which are basically materials capable of at least 75 percent elongation without rupture. Such materials generally should have a Young's modulus by stretching which is less than 25,000 psi. Typical materials may be of the butadiene acrylonitrile type, or other natural or synthetic rubber latices or dispersions thereof with elastomeric properties, such as butadiene-styrene, vinyl copolymers, or vinyl ethylene terpolymer. The elastomeric properties may be improved by the addition of suitable plasticizers with the resin.

The amount of bonding material applied to the webs can be varied over a wide range while still realizing many of the benefits of the invention. However, because the preferred products of the invention are absorbent wiper products, it is desirable to keep the amount of bonding material to a minimum. In the preferred forms of the invention, it has been found that from about 3 percent to about 20 percent of total bonding material (based upon dry fiber weight of the finished web product) is satisfactory, and from about 7 to 12 percent is preferred.

The creping drum 69 may in some instances comprise a heated pressure vessel such as a Yankee dryer or, in other instances, may be a smaller roll and may be unheated. The necessity for heating depends upon both the characteristics of the particular bonding material employed and the moisture level in the web. Thus, the bonding material may require drying or curing by heating in which case the creping drum may provide a convenient means to accomplish this. Alternatively, the moisture level of the web being fed to the creping drum may be higher than desired, and the creping drum may be heated to evaporate some of this moisture. Some bonding material may not require the curing step effected by the curing station 72.

It has been found that from about 3 to about 20 percent produces a desirable product, and from about 7 to about 12 percent per creping operation is preferred.

It is preferred that the bonding material migrate through only a minor portion of the thickness of the web. It is important to the invention that the bonding materials which create the strong surface regions do not generally extend all the way through the web, whether it is bonding material from one surface of the web extending through to the other surface, or bonding material from one surface extending into contact with bonding material from the other surface. It is the portions of the web which do not have the bonding material applied in the steps of the invention that are most greatly affected by the controlled pattern creping to form the soft, absorbent central core region. The best way to assure that excessive penetration of the bonding material does not occur is to limit penetration of the bonding material on either side of the web to no more than about 40 percent through the thickness of the finished web product. More preferably the bonding material extends less than about 30 percent through the thickness of the web. In some embodiments, the penetration of the bonding material on one side of the web may be more than 40 percent, up to 60 percent, as long as the penetration of the bonding material on the other side of the web is not so great as to interconnect the bonding materials from both sides of the web.

However, it is also highly preferable, in order to obtain the greatest advantage of the invention, that the bonding material penetrate a significant distance into the web from the surface, at least 10 percent of the web's thickness, and more preferably at least 40 percent. This degree of penetration will assure creation of the desirable properties in the surface regions as described above.

Migration and penetration of the bonding material is influenced, and thus can be controlled, by varying the basis weight of the web itself and by varying the pressure applied to the web during application of the bonding material thereto, since wicking through the web is enhanced when the fibers are compacted closely together. Also, changing the nature of the bonding material and its viscosity will affect migration and penetration of the bonding material. In addition, varying the amount of time between application of the bonding material and setting or curing of the material will affect penetration, as well as varying base web moisture content and pressure roll loading at the dryer. A determination of the exact required conditions is easily within the skill of a papermaker without undue experimentation once the particular bonding material and amount of penetration is chosen.

At occasional locations, some of the bonding material will penetrate further or less than desired due to inherent process and base web deviations. The critical and preferred ranges of bonding material penetration and migration expressed herein, therefore, refer only to the great majority of the web and does not preclude the possibility of occasional variances. It may even be desirable in some cases, to purposely cause deeper penetration of the bonding material at selected locations occupying less than about 10 percent of the surface area of the finished web to tie the surfaces of the web together without unduly diminishing the absorbency and bulk of the central core region. Such deeper penetrations can be caused by deeper engraved lines or dots at spaced locations on the rotogravure roll. Such practices are to be considered within the scope of the invention.

Specifically, according to the present invention, the bonding agent is applied to each side of the layered paper web so as to cover from about 35 percent to about 55 percent of the surface area of the web. More particularly, in most applications, the bonding agent will cover from about 40 percent to about 50 percent of the surface area of each side of the web. The total amount of bonding agent applied to of the web will preferably be in the range of from about 4 percent to about 20 percent by weight, based upon the total weight of the web. In other words, the bonding agent is applied to each side of the web at an add-on rate of about 2 percent to about 10 percent by weight.

At the above amounts, the bonding agent can penetrate the paper web from about 20 percent to about 40 percent of the total thickness of the web. In most applications, the bonding agent should not penetrate over 50 percent of the web but should at least penetrate from about 10 percent to about 15 percent of the thickness of the web, and most preferably at least about 40 percent.

A "double depth" gravure roll pattern with two depths of cells has been previously disclosed in U.S. patent application Ser. Nos. 08/484,591 and 09/039,933, both filed Jun. 7, 1995, and both of which are incorporated herein in their entireties by reference.

The bonding agents applied to each side of paper web 19 are selected for not only assisting in creping the web but also for adding dry strength, wet strength, stretchability, and tear resistance to the paper. The bonding agents also prevent lint from escaping from the wiping products during use.

The bonding agent is applied to the base web as described above in a preselected pattern. In one embodiment, for instance, the bonding agent can be applied to the web in a reticular pattern, such that the pattern is interconnected forming a net-like design on the surface.

In a preferred embodiment, however, the bonding agent is applied to the web in a pattern that represents a succession of discrete dots. Applying the bonding agent in discrete shapes, such as dots, provides sufficient strength to the web without covering a substantial portion of the surface area of the web. In particular, applying the bonding agents continuously to the surfaces of the web adversely affects the web. Thus, it is preferable to minimize the amount of bonding agent applied.

Once wound into a rolled material, the wiping product of the present invention can then be transferred to another location and cut into commercial size sheets for packaging as a wiping product.

The following examples are meant to be exemplary procedures only which aid in the understanding of the present invention.

EXAMPLE 1

In this example, a never pressed/never creped base paper obtained from a 20-inch experimental papermaking machine of Kimberly-Clark Corporation located in Neenah, Wis., was utilized.

In this particular example, a three-layered web was used consisting of a top layer of Pictou Northern Softwood Kraft (NSWK), a middle layer of Mobile Wetlap Southern Pine, and a bottom layer of Pictou Northern Softwood Kraft. The outer surface layers of Pictou NSWK composed 25 percent by weight each and the middle layer of Mobile Wetlap Pine comprised 50 percent. Thus, in the final three-layered web, half of the web was Mobile Wetlap Pine, and the other half was Pictou NSWK. The Mobile Wetlap Pine provided bulkiness in the middle of the web.

The three-layered never-pressed/never-creped paper web was subjected to the print-print-crepe process described above after being formed on a papermaking machine similar to that shown in FIG. 2 (with rush transfer). Specifically, one surface of the three-layered paper was printed with latex in a 0.090"×0.060" hexagonal pattern. Then, latex was printed onto the other surface of the three-layered web in the same gravure pattern. The web was then pressed to a creping drum with a silicone presser roll of 65 shore A hardness. This caused the web to adhere tightly to the drum and to adhere slightly to the presser roll. The web was then dried on the drum and creped from it. These steps were carried out in accordance with that described above with respect to FIG. 3.

When a Teflon-covered rubber presser roll or a silicone-sprayed roll was substituted for the silicone presser roll, the web did not adhere to it as well and the resulting creped product did not have the significantly higher caliper resulting from use of the silicone presser roll.

The print-print-crepe product was then compared to other products and the results are indicated in Table 1 below. Specifically, the print-print-crepe product of the present invention was compared to a double recreped product, which had been produced by the double recrepe process disclosed in Gentile et al. (FIGS. 1 and 2), a print-crepe-print paper of this invention, and a paper which had been printed on both sides but not creped. The following table indicates the comparison of Basis Weight in pounds per ream, Bulk per Basis Weight (BW) (with bulk in mils per 24-sheet thickness under 0.5 psi weight), and CDWT in ounces per inch width after being cured.

TABLE 1

| Product | Basis Weight (LB/R) | Bulk/BW | CDWT (oz/in) |
|---|---|---|---|
| Double Recrepe | 31.5 | 20.3 | 5.5 |
| Print-print-crepe* | 28.7 | 20.6 | 5.5 |
| Print-crepe-print | 28.8 | 15.4 | 5.0 |
| print-print | 26.4 | 8.8 | 7.2 |

*Example 1

The present invention provides advantages over the double recreped product disclosed in the Gentile et al. patent due to the lower processing costs and few process steps involved. Obviously, two creping processes are avoided by the present inventive method. This simpler process allows the product to maintain all of the advantages of the product made according to the commercial double recrepe process. The product maintains the bonded reinforced surfaces of the double recreped process while additionally possessing the characteristics associated with layered fiber webs.

In addition, the present process allows for a multi-layered sheet product capable of having two very different topographies on the two surfaces. In addition, one surface that has not been creped has a higher abrasion resistance than the surface which has been creped. Additionally, the utilization of different binders on the two surfaces can result in optimization of product and process. For example, one could use a lower solids containing, more efficient print fluid on the first printed side or a different colored print fluid. In addition, the use of a multilayered web would allow different colored webs to be used to signify different uses for the two surfaces or, simply, for aesthetic reasons.

Although a preferred embodiment of the invention has been described using specific terms, devices, and methods, such description is for illustrative purposes only. The words used are words of description rather than of limitation. It is to be understood that changes and variations may be made by those of ordinary skill in the art without departing from the spirit and scope of the present invention which is set forth in the following claims. In addition, it should be understood that aspects of the various embodiments may be interchanged, both in whole or in part.

What is claimed is:

1. A method for producing a wiping product comprising the steps of:

a) providing a multi-layered paper web containing pulp fibers, said paper web having a first surface and a second surface;

b) applying a first bonding agent to said first surface of said web in a preselected pattern:

c) applying a second bonding agent to said second surface of said web in a preselected pattern;

d) delaminating said web and adhering said web to a creping surface by contacting said first surface of said web with the surface of a presser roll and then pressing said web to said creping surface so that said web adheres tightly to said creping surface and lightly to said presser roll surface to allow said web to delaminate and exhibit an increase its caliper; and e) creping from said creping surface said second surface of said web that is adhered tightly to said creping surface.

2. The method as defined in claim 1, wherein said paper web comprises at least three pulp layers.

3. The method as defined in claim 1, wherein said first bonding agent is applied to said first surface of said paper web in a pattern that covers from about 20 percent to about 50 percent of the surface area of said first surface and wherein said second bonding agent is applied to said second surface of said paper web in a pattern that covers from about 20 percent to about 50 percent of the surface area of said second side.

4. The method as defined in claim 1, wherein said second surface is adhered to said creping surface and is creped therefrom.

5. The method as defined in claim 1, wherein said first bonding agent and said second bonding agent comprise a material selected from the group consisting of an acrylate, a vinyl acetate, and a methacrylate.

6. The method as defined in claim 1, wherein said first bonding agent is applied to said first surface of said paper web in an amount of from about 2 percent to about 10 percent by weight based on the total weight of said paper web and wherein said second bonding agent is applied to said second surface of said paper web in an amount of from about 4 percent to about 8 percent by weight based on the total weight of said paper web.

7. The method as defined in claim 1, wherein said paper web after being creped from said creping surface is embossed with a pattern by contacting said creped paper web with an embossing roll.

8. The method of claim 1, wherein said presser roll is a silicone presser roll.

9. The method of claim 1, wherein said presser roll is a silicone presser roll having a 65 shore A hardness.

* * * * *